United States Patent [19]

Morrison et al.

[11] 4,308,435

[45] Dec. 29, 1981

[54] DIGITAL DISPLAY AND SWITCH APPARATUS FOR AUTOMOBILE ACCESSORY

[75] Inventors: David Morrison, Atlanta, Ga.; Ralph C. Robinson, Charlotte, N.C.

[73] Assignee: General Time Corporation, Thomaston, Conn.

[21] Appl. No.: 44,250

[22] Filed: May 31, 1979

[51] Int. Cl.[3] ..... H01H 3/00

[52] U.S. Cl. ..... 200/17 R

[58] Field of Search ..... 200/5 R, 5 B, 5 C, 5 D, 200/5 E, 17 R, 18, 153 LA, 153 L, 153 S, 51 R, 51.09–51.12; 361/413

[56] References Cited

U.S. PATENT DOCUMENTS

| | | | |
|---|---|---|---|
| 2,505,862 | 5/1950 | Kallmann | 200/5 E X |
| 2,870,273 | 1/1959 | Merchant | 200/5 R UX |
| 3,542,988 | 11/1970 | Baldasare | 200/153 J X |
| 4,069,403 | 1/1978 | Beaudette et al. | 200/51.12 |

*Primary Examiner*—James R. Scott

*Attorney, Agent, or Firm*—Pennie & Edmonds

[57] ABSTRACT

One or more switch apparatus for controlling a digital display of a changing function each include stationary and movable contacts and an actuator having a rest position and movable longitudinally in opposite directions to second and third positions. Cam structure is supported on each actuator to interact with a follower carried by each movable contact whereby different conditions of switch operation may be indicated by the position of the actuator relative to the movable contact. Biasing structure intercooperates between each actuator and a support for biasing the actuator toward the rest position from at least one of the second and third positions. A latch, also, intercooperates with each actuator to latch the actuator in one of the last-mentioned positions.

27 Claims, 16 Drawing Figures

DIGITAL DISPLAY AND SWITCH APPARATUS FOR AUTOMOBILE ACCESSORY

TECHNICAL FIELD

The present invention relates to switch apparatus in a digital display device having at least one switch operator movable selectively from a first position to one of a second or third position for energizing the display of the then current condition of one of several changing functions, such as time, elapsed time and date. The digital display device is particularly adapted for use as an accessory for an automobile and in this adaptation conveniently may be mounted in the dashboard within view of the operator.

BACKGROUND ART

Digital display apparatus of the type capable of being energized for purposes of display of a changing function are known to the prior art. And, it is known to provide such digital display as an accessory of an automobile, the energizing source then comprising the battery serving the other electrical functions, as well.

One prior art patent which may be typical of a showing of the general combination of an automobile and, as an accessory, a digital display apparatus is U.S. Pat. No. 4,022,017 to M. Aoki et al. The Aoki et al patent otherwise is directed to the electronic circuit rather than switch apparatus of the type to be set out herein, and accordingly, is not concerned with the problem heretofore encountered in the mounting of switch apparatus on a printed circuit board.

DISCLOSURE OF INVENTION

The present invention relates to a switch apparatus adapted to be incorporated with a printed circuit board to control an electronic circuit, such as that of a digital display device, capable of display of one of several changing functions. By the present invention, the problem heretofore encountered is overcome and the switch apparatus of this invention functions in a relatively easy, positive manner in the control of the display.

The switch apparatus includes at least a single stationary contact blade supported by the printed circuit board and a movable contact for each stationary contact mounted by a support for the printed circuit board. The movable contact is cantilever mounted with a position of contact with the stationary contact. An actuator for each switch apparatus is carried by the support for movement in opposite directions from a rest position. The actuator controls movement of the movable contact with which it is associated and may be latched to prevent movement in return to the rest position following movement in one of the two directions.

Particulars as to the operation of a preferred embodiment of the invention may be gleaned from the description to follow.

BEST MODE FOR CARRYING OUT THE INVENTION

The present invention is directed to switch apparatus for a digital display having capability through selective switch actuation of providing for viewing the current condition of the selected one of several changing functions.

Figure 1:
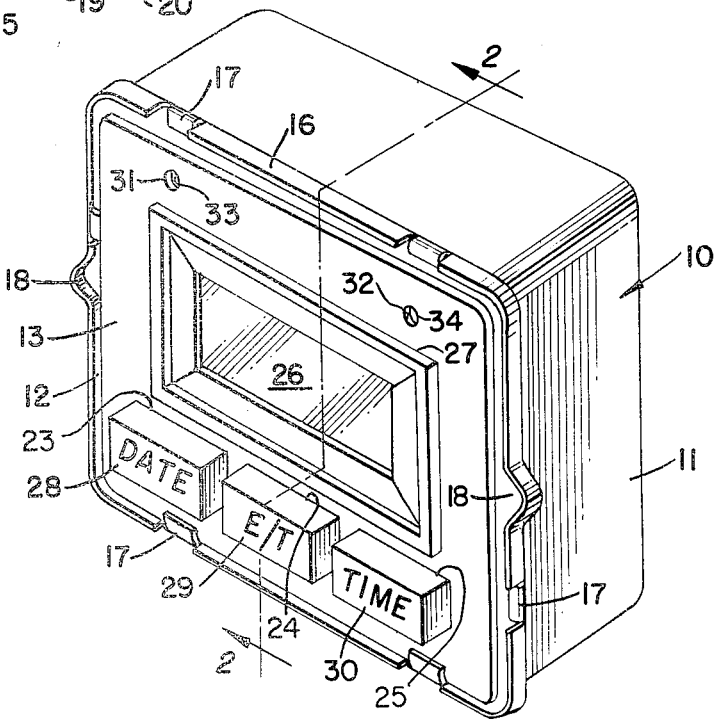
FIG. 1 is a perspective view of the digital display apparatus of the present invention.

The electronics of the digital display, as well as the structure to be described, may be enclosed by a casing 10, illustrated in FIG. 1. The casing includes a rear portion 11 supported by a front plate portion 12, or vice versa. A bezel 13 is carried by the front plate portion.

The digital display may comprise an accessory for an automobile. And, the casing is mounted, preferably, in the dashboard (not shown), within view of the operator. Any particular manner and means of mounting the casing in the dashboard may be resorted to within the context of this invention.

In the present adaptation, the changing functions may be, for example, the function of time presented in minutes and hours (hereinafter "TIME"), elapsed time (hereinafter "E/T") and date presented in month and day (hereinafter "DATE").

A pair of circuit boards 14 and 14' upon which the electronics of the digital display may be disposed is received within the rear portion 11 of the casing 10 and enclosed by the front plate portion 12. According to one manner of mounting, the rear portion of the casing may provide a shoulder 15 and a lip 16 peripherally therearound. The front plate portion is juxtaposed to the shoulder and secured by a plurality of tongues 17 struck from the lip and bent over the front plate portion. An ear 18 extending from at least opposite sides of the front plate portion is located to each of a pair of complementary outward grooves to provide proper alignment of the structures.

A plurality of posts 19 are integral with or carried by the front plate portion to extend coextensively rearwardly into the confines of the rear portion 11. The posts may be disposed within the region of the corners to provide a mount for circuit boards 14 and 14'. To this end, each post includes, from the extended end, a length of smaller cross-section to provide a shoulder between its ends. Each of the lengths are coextensive, and by provision of a plurality of openings complementary in cross-section to that of the posts, circuit board 14' may be moved to a supported position on the shoulders. A collar 20 received about each post serves to space circuit boards 14 and 14'. A screw 21 received through circuit board 14 may be threaded into each post to fix the structures in position.

The electronics of the digital display, per se, may be considered conventional in that it forms no part of the invention aside from the combination with operative structures whereby through selective actuation of the respective gripping portion of each actuator of each switch apparatus, a display of digital information of a desired function may be derived, updated, recycled and so forth, as may be conventional.

The front plate portion 12 mounts the bezel 13 in any convenient manner and both the front plate portion and the bezel provide a plurality of openings which are coaxial in arrangement. A centrally located opening 22 of rectangular outline serves as a viewing area for the display of digital information. This information may be provided by the energization of light emitting diodes, liquid crystals or the like, illustrated schematically at 50. The other electronics is not illustrated, nor is the connection between the electronics on the two circuit boards. A further plurality of openings 23, 24 and 25 are located below the viewing area to accommodate the gripping portion or button which, on command, may be manipulated to display one of the aforementioned readouts. Each button and opening, also, is rectangular in outline.

An assembly including a lens 26 and frame 27 are received within thereby to close the opening 22. The lens preferably will be of a material having good optical transmission capability. Further, the lens preferably will be of a color which accentuates the wavelength of the emitted display. Further still, the lens may be supported at the base of a surface bevelled or inclined away from the frame. The buttons, identified by the numerals 28, 29 and 30, extend through openings 23, 24 and 25, respectively, thereby to be in a position in front of the bezel 13 for ease in manipulation by the operator as the occasion warrants. The buttons carry on their face indicia representing the particular function of the switch apparatus to be controlled.

Briefly, for the sake of discussion, a display of digital information may be provided by the energization of light emitting diodes and the structure provides a plurality of light pipes extending between individual sources of light and a front plane segmented in the conventional 7-segment outline. A plurality of four display locations, two of which are located on opposite sides of a centrally located colon, may be provided. By energization of selected light sources, any decipherable display of numeric indicia may be provided. The colon will be illuminated, either in a blinking or non-blinking fashion, when the digital display is illuminated, as may be determined. A blinking colon will be indicative of passage of a seconds' time. Indicia, such as a dot, illuminated when the digital display is illuminated, may be provided to distinguish "AM" and "PM". Alpha indicia, as last described, may be provided also; and, a readout of time may be in a 12- or 24-hour format.

The actuators controlled by buttons 28, 29 and 30 have capability either of being pushed in or pulled out relative to a center or intermediate position (hereinbefore referred to as "rest position"). Movement of an actuator in one or the other direction from the center or intermediate position may result in a latching of the actuator for purposes, among others, either of recycling or updating the digital display. To this end, the front plate portion 12 and bezel 13 provide a pair of aligned openings 31 and 32. A button 33 and 34 extends into but is recessed in each opening, as seen from the front in FIG. 1. If the actuator for the digital display of the function of time is latched, these buttons may be depressed to set or update minutes and hours, as is conventional. Setting or updating of the function of TIME, as all functions, may be carried out at a rate, for example, of 2 Hz.

Figure 2:
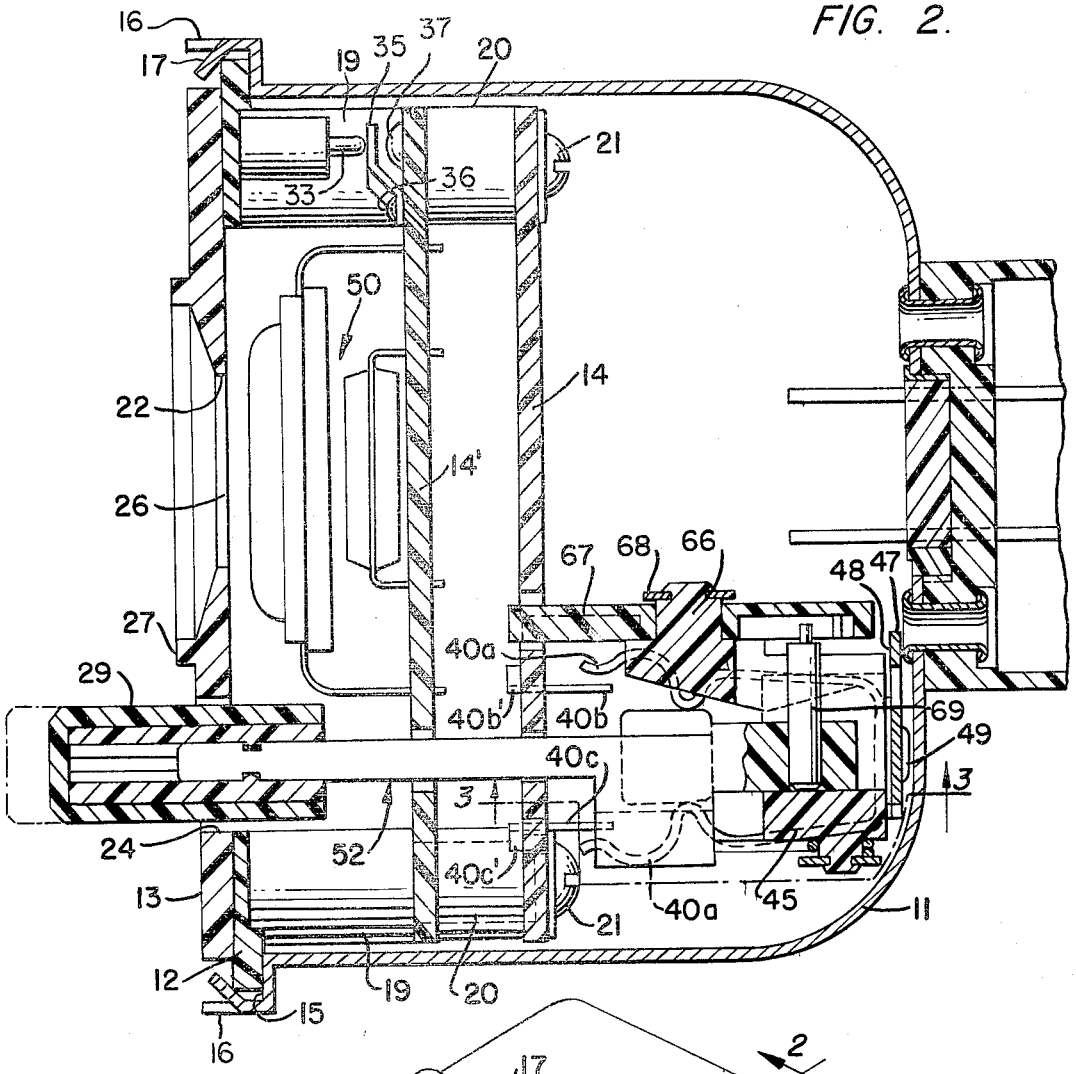
FIG. 2 is a view in section as seen along the line 2—2 in FIG. 1.

Each button 33 and 34 includes an extending portion. FIG. 2 illustrates the button 33 and extending portion (the button 34 and operation may be considered similar) for control of movement of an arm 35 extending in cantilever fashion from a contact, into a position of contact with a second, stationary contact. As illustrated, the contacts are identified by the numerals 36 and 37. If each button and extending portion is spring biased (not shown) away from the circuit boards, the contacts 36–37 normally will be open.

The actuators controlled by the buttons 28 and 30 may be latched in the "out" position and all buttons may be moved both inwardly and outwardly from the center or intermediate position. In inward movement of the actuator controlled by button 29, a latching action will occur. The manner of latching will be described below.

Normally, all actuators and buttons will be located in a "center" position. With the ignition of the automobile "off", it is desirable to conserve the power of the source and, therefore, no display will be provided. However, a display either of the function DATE or TIME may be provided upon selective depression of the button 28 or 30, respectively. The particular display selected will continue over the period during which the button is depressed and for a short time interval thereafter. While the integrated circuit may provide any sequence of display, normally, when the ignition is turned "on", the function of TIME will be displayed continuously. At any time, the function of DATE may be displayed when button 28 is depressed. The display of this function overrides the display of TIME and will continue during the period of time that the button is depressed and for the short interval of time thereafter. A short time interval may be about 5 seconds.

The actuator controlled by buttons 28 and 30 may be latched for purposes of setting or updating the respective displays. To this end, and when that particular actuator is latched, the button 33 or 34 may be depressed by a pin, for example, to close the switch previously described and rapidly sequence the display to the proper or desired condition of that function. Normally, the setting or updating either of the function of TIME or DATE may not be carried out if the ignition is "off".

The actuator controlled by the button 29 may be latched in the "in" position of movement from the center position. The display of the function E/T likewise overrides the normal display when the actuator is latched. The display E/T may be a display of time from the start of a trip as is then stored in a register. The display will continue to read the updated storage of the register during the time the actuator is latched.

The register may be set to zero count at any time, first by unlatching the actuator, if latched, to return it to a center position and then by pulling the actuator out. The electronics may be such that if the actuator is immediately relatched, the display to be observed may be that of seconds within the two right-hand display locations and minutes within the two left-hand display locations. Thus, the E/T display may allow operation as a stop watch. After a period of time, the display will be of minutes and hours and will reset or recycle to zero at the completion of some interval, say 19 hours and 59 minutes. The display of minutes and seconds may continue for about 20 minutes.

Figure 4A:
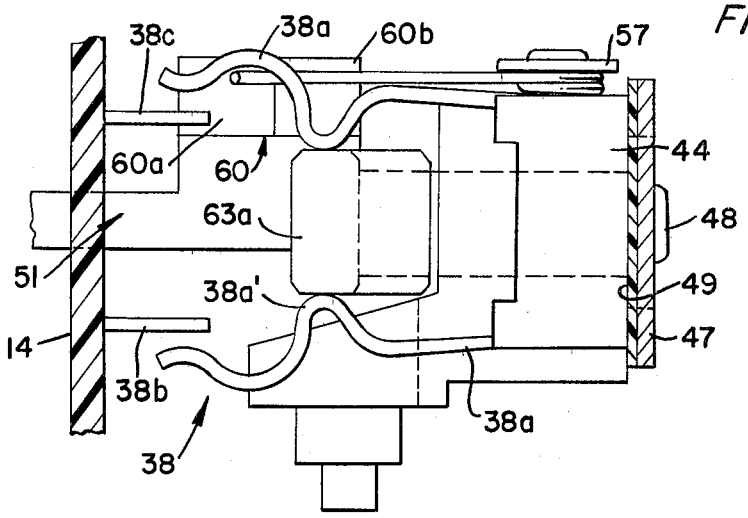
FIG. 4A is a view in elevation and partially in section as seen along the line 4A—4A in FIG. 3.

The particular switching operation may be better understood with reference both to the series of FIGS. 4A, B and C, and 5A, B and C, as well as the following Table:

| Position | DATE (Switch 38 | 39) | E/T (Switch 40 | 41) | TIME (Switch 42 | 43) |
|---|---|---|---|---|---|---|
| IN | C | C | C | O | C | C |
| CENT. | O | O | O | O | O | O |
| OUT | O | C | O | C | O | C |

(In the above Table, "C" indicates that the switch is closed, and "O" indicates that the switch is open.)

Each switch apparatus includes a pair of switches of single-pole, single-throw type, an actuator support structure for the switch components, a button attached to an actuator for controlling movement of that actuator and structure for latching the respective actuators either in the "in" or "out" position relative to a "center" position. The switch apparatus for each of the DATE and TIME functions are identical both in make-up and operation, and differ principally from the switch apparatus for the E/T function in the manner of latching and in the position of latching.

Figure 3:
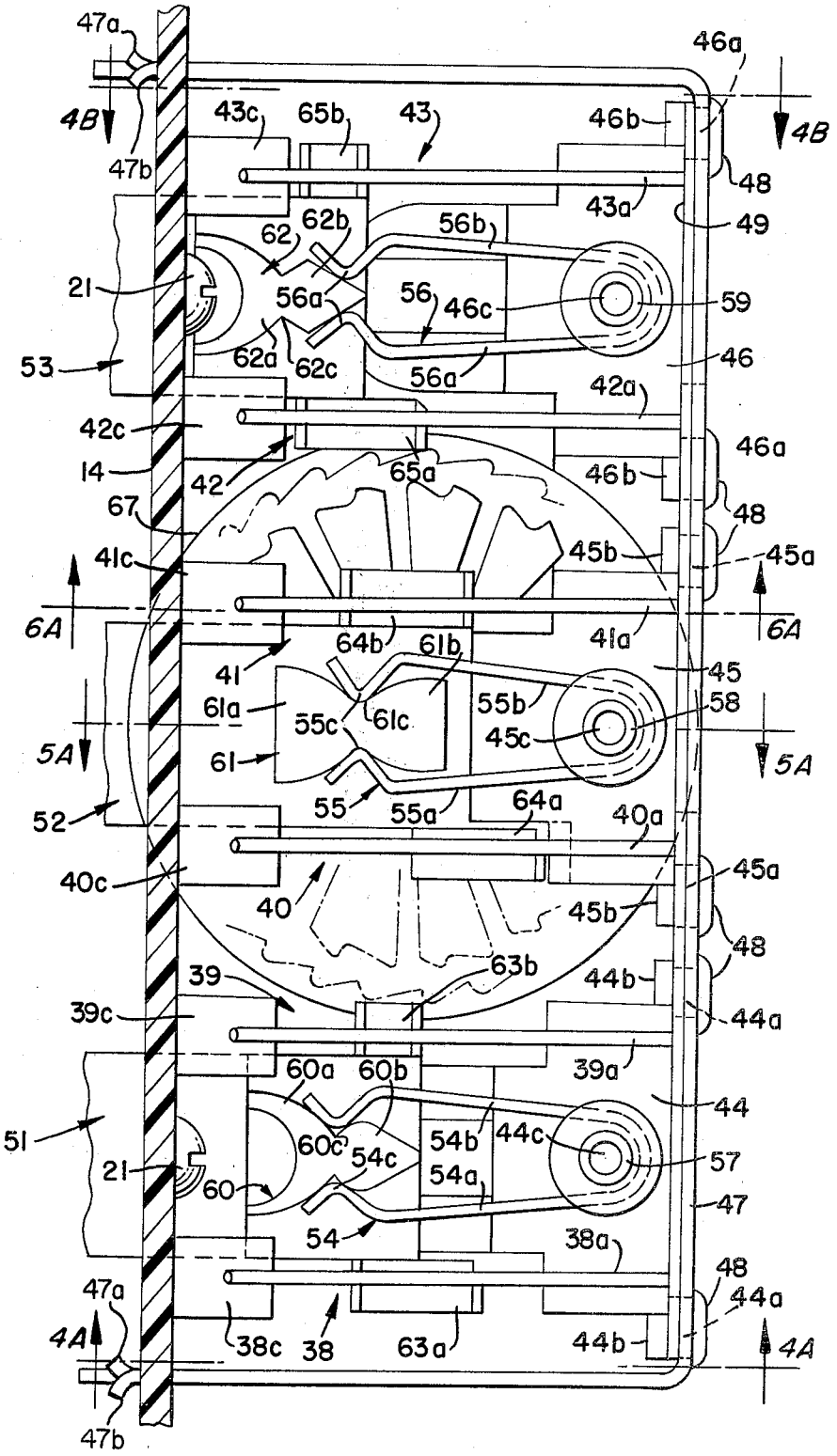
FIG. 3 is a view in section as seen along the line 3—3 in FIG. 2.
Figure 4B:
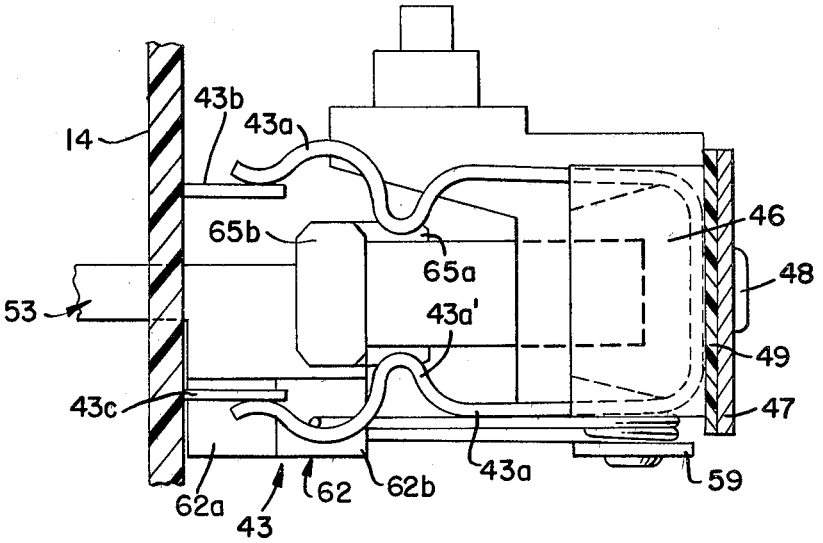
FIG. 4B is a view similar to that of FIG. 4A as seen along the line 4B—4B in FIG. 3.

Referring to FIG. 3, and consistent with the above Table, switches 38 and 39 control the DATE function, switches 40 and 41 control the E/T function, and switches 42 and 43 control the TIME function. Each switch includes a movable contact arm 38*a*, 39*a*, . . . *43a* having generally a U-shaped outline (see FIG. 4B) and a pair of stationary contacts 38*b, c*, 39*b,c* . . . 43*b,c*.

A member forming a portion of the support structure mounts both contact arms of each pair of contact arms so that the end portions of each of the extensions are disposed within the region of the stationary contacts. Thus, upon movement of the actuator associated with each pair of contact arms, as will be described, the contact arms may be controlled to and from a position of contact with the stationary contacts to close the switch. Particularly, a member 44 mounts the arms 38*a* and 39*a;* a member 45 mounts the arms 40*a* and 41*a;* and a member 46 mounts the arms 42*a* and 43*a*. Each of the members is similarly formed and carried by a frame 47, comprising a further component of the support structure.

Circuit board 14 also comprises a component of the support structure. To this end, the circuit board mounts both the frame and the several pairs of stationary contacts. Thus, an end of each stationary contact extends through a slot (see FIG. 2) provided for this purpose. The stationary contacts of each switch are coextensive within the contact area and positioned one above the other (see FIGS. 3 and 4A). And, each stationary contact may be connected in the electrical circuit at a terminal 38*b'*, *c'*, 39*b'*, *c'* . . . 43*b'*, *c'* (see FIG. 2). The stationary contacts may be of a phosphor bronze and within a roughened or rippled contact area coated with a silver inlay (not shown) for enhancement of electrical contact.

Frame 47 has a U-shaped outline and carries a pair of tabs 47*a,b* at the end of each leg. The frame extends rearwardly of circuit board 14 thereby to at least partially enclose the several switch apparatus. The tabs are also received through slots in the circuit board, and the frame may be secured by bending each of the paired tabs oppositely as may be seen in FIG. 3.

The frame may be fabricated from any metal or plastic material. In a preferred form of the invention, the frame is fabricated from a CRS, such as AISI 1010–1020, Rockwell "B" Scale, and zinc plated. Each member may be mounted by the frame at spaced locations along the base. To this end, a stud, either integral with or carried by an extension on each side of each member, is gripped by a locking ring 48 moved into juxtaposition with the frame. The studs are identified as 44*a*, 45*a* and 46*a* and the extensions are identified as 44*b*, 45*b* and 46*b*.

A strip 49 of material having insulative capability, such as fishpaper, is disposed between the members and frame. Preferably, the strip will include a plurality of openings through which the studs project and the mounting of the members will locate the strip. The members may be fabricated, such as molded, of plastic. A nylon material (ZYTEL 101) has been used successfully. The circuit boards 14 and 14' are formed conventionally and of conventional insulative material.

While each movable contact arm is electrically isolated from the frame by the thickness of the insulative material, which in the preferred embodiment may be about 0.015 inch in thickness, it, also, will be spaced somewhat from the insulative material by the manner of support provided by the particular member. Thus, as may be seen in FIGS. 4A and 4B, for example, the several movable contact arms are recessed in a groove extending along the side facing the strip and the adjacent sides. As will be described, other portions of the switch apparatus are formed of plastic and, accordingly, each switch is electrically isolated from all other switches.

Each actuator 51, 52 and 53 is of extended length including a forward portion, an operative portion and a rear portion. The forward portion of each actuator generally is of rectangular, plate-like outline. When the actuator is in the "center" position, the forward portion will extend from a position within the region of front plate portion 12 to a position rearward of the circuit board 14. A button, such as button 28, is mounted, for example, by a friction mount on the end of the forward portion of the respective actuators. As previously mentioned, the button is grasped or otherwise manipulated to control the desired function. The rear portion of each actuator is rectangular in cross-section and extends into an opening of complementary cross-section in each of the respective members 44, 45 and 46. Thus, the rear portion of each actuator is supported for movement by one of the members, whereas the forward portion of the actuator is supported by a button within one of the openings 23, 24 and 25. Further support in movement is provided by the circuit boards 14, 14' through which the actuators project.

The operative portions of the actuators 51, 52 and 53 serve several functions. To this end, referring to actuators 51 and 53 (which control the DATE and TIME function, respectively), the operative portions control movement of the movable contact arms (arms 38*a*, 39*a*, 42*a* and 43*a*). Additionally, the operative portions limit movement of the actuator through engagement with the circuit board 14 in one direction from the "center" position and through engagement with a member (member 44 and 46) in the other direction from the "center" positon. And, each of the operative portions acting in concert with a detent spring serve both as a latching structure to latch the actuator after having been relocated in one of the directions and a biasing structure to bias the actuator to the "center" position after having been relocated in the other direction. The operative portion of actuator 52 (which controls the E/T function) also serve several functions. To this end, it similarly controls movement of the movable contact arms (arms 40*a* and 41*a*) and limits movement of the actuator through engagement with the aforementioned structure. Further, and again in concert with a detent spring, the operative portion serves to bias the actuator to the "center" position from both the "out" position and the "in" position after the actuator has been unlatched. Latching of the actuator 52 is carried out in a manner to be described.

A stud is carried by or integral with each number 44, 45 and 46. Each stud, identified further by the suffix c, extends upward from one of the sides of the member adjacent the side facing the strip 49 of insulative material. A detent spring 54, 55 and 56 (see FIG. 3) is received over a respective stud. Particularly, the detent spring may be supported by several convolutions so that legs 54*a,b,* for example, are resiliently biased toward one another. Each leg includes a reverse bend near its end providing a pair of follower surfaces 54*c*. Typically, the detent springs may be formed of music wire (0.020 D).

A washer 57, 58 and 59 provides mounting securement for the detent springs. To this end, each washer is received by a stud, for example, stud 45*c* (see FIG. 5A), over the detent spring, and secured in any conventional manner. As illustrated, the washer may be received in an annular groove. For consideration of strength, the washers are fabricated of a material like that of frame 47.

The operative portion of each actuator includes a cam element 60, 61 and 62. The cam elements may be supported by or integral with the operative portion and extend away from the surface of the operative portion in the direction of the last-mentioned studs. Referring to FIGS. 3 and 4A, the cam element 60 includes a base 60*a* and a head 60*b*. The base is formed by a pair of outward divergent walls, which may be somewhat arcuate in outline. The head is formed by a pair of walls converging toward a tip. The walls of the head and base are connected by a grooved region 60*c*.

The cam element 62 is formed in a like manner, and each of the bases are hollowed-out thereby to accommodate the head of the screws 21 when the actuators are in the "out" position.

The cam element 61 follows somewhat the make-up of the cam elements 60 and 62. In this connection, the base 61*a* includes a pair of outward divergent walls, and a head 61*b*, likewise having outward divergent walls, which extends from a groove region 61*c*.

The operative portion of each actuator further includes a wing disposed on each of the opposed surfaces adjacent to the surface from which the stud extends. To this end, wings 63*a,b* are carried by actuator 51, wings 64*a,b* by actuator 52, and wings 65*a,b* by actuator 53. Each wing includes an upper and lower surface coextensive in length and coextensive at least throughout the portion of that length with the upper and lower surface of the wing on the opposed side of the actuator.

As was previously stated, each movable contact arm 38*a*, 39*a*, . . . 43*a* is generally U-shaped. Referring to FIG. 4A, for example, the extensions include a reversely curved region 38*a'*, 39*a'*, . . . 43*a'*. This region is located between the base of the movable contact arm and the end region which is formed with an arcuate, outward contour. The movable contact arms are formed of phosphor bronze wire (0.022±0.001 D), which may be silver-plated, and spring tempered to a position such that the regions tend to close upon one another. These regions each comprise a follower and the surfaces each comprise a cam. Accordingly, as will be described, and dependent upon the position of the actuator, the follower may reside on the cam or it may have moved off the cam.

Referring again to FIG. 3, the actuators 51 and 52 are in the "center" position, and the actuator 53 is latched. Thus, the latching action of the actuator (and actuator 51) follows from movement to the "out" position so that the follower surfaces 56*c* (and 54*c*) engage the surfaces of head 62*b* (and 60*b*). Movement of the actuator in return to the "center" position requires that the actuator be pushed in whereby the follower surfaces yield in their movement into the grooved regions 62*c* (and 60*c*). Movement of the actuators in the opposite direction cause the follower surfaces to move along the base 62*a* (and 60*a*). The resilient biasing force acting to return the legs together, imparts movement to the actuator in return automatically to the "center" position.

Figure 5A:
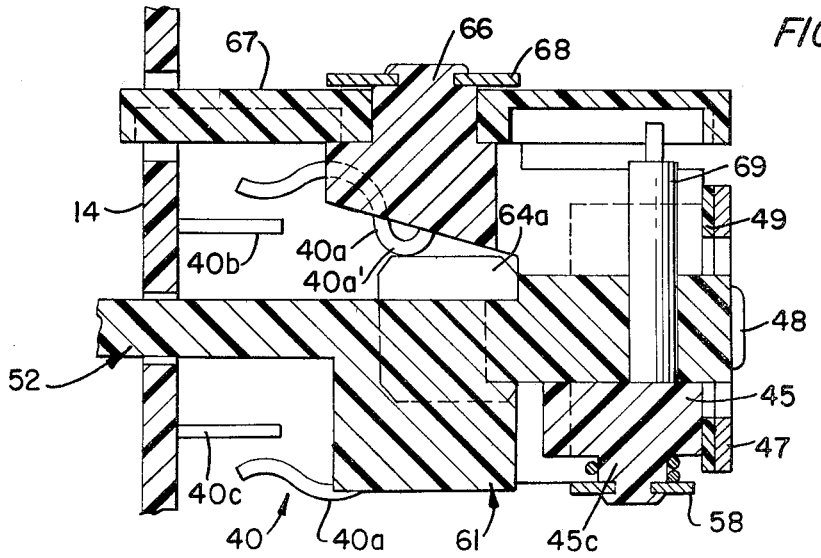
FIG. 5A is a view in section as seen along the line 5A—5A of FIG. 3.
Figure 4C:
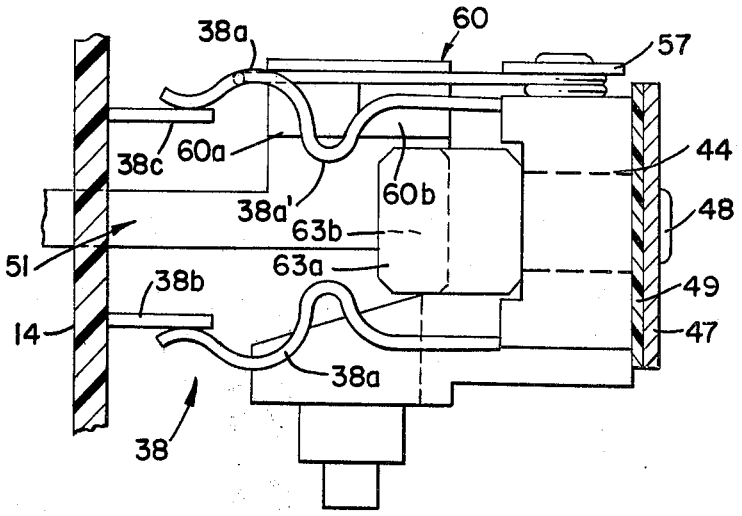
FIG. 4C is a view similar to FIGS. 4A, 4B, yet illustrating the actuator of a switch apparatus in a different position.
Figure 7B:
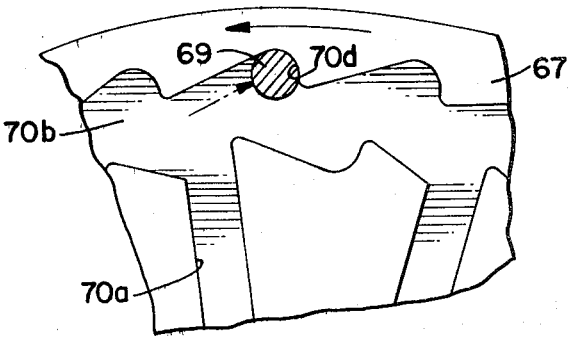
FIGS. 7A, 7B, 7C and 7D are partial views of a form of latch mechanism for latching one of the actuators.
Figure 7A:
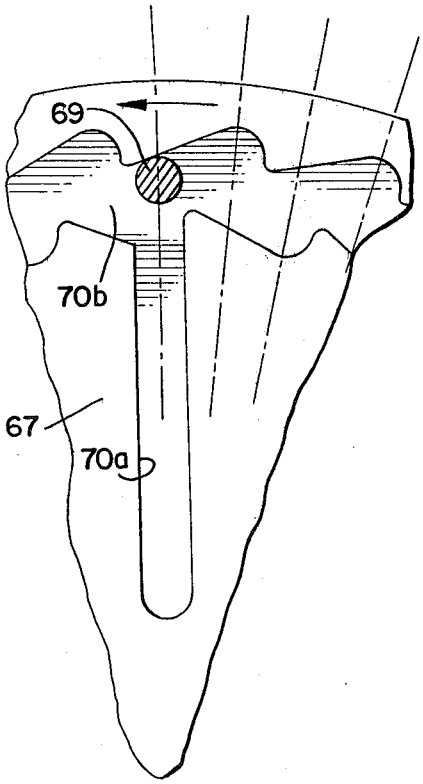
Figure 7C:
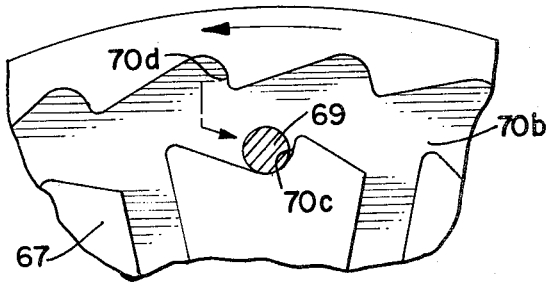
Figure 7D:
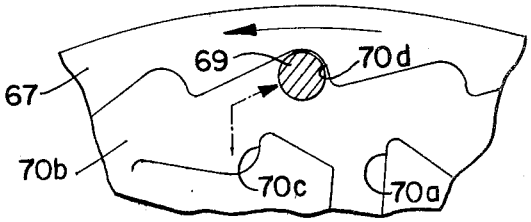
Figure 6A:
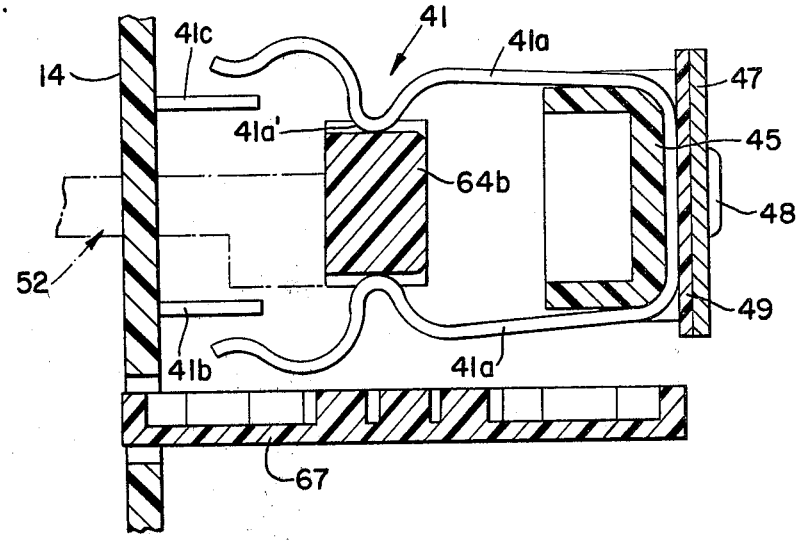
FIGS. 6A, 6B and 6C are views in elevation, schematically illustrating the actuator of a switch apparatus in different positions.
Figure 6B:
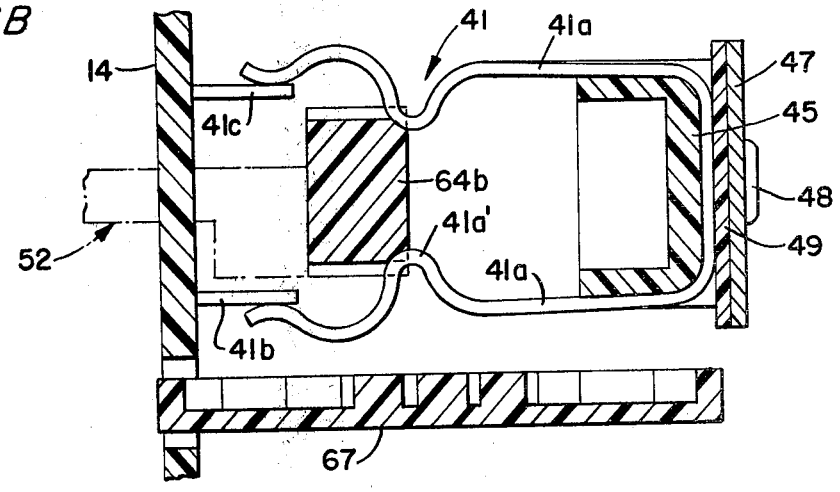
Figure 6C:
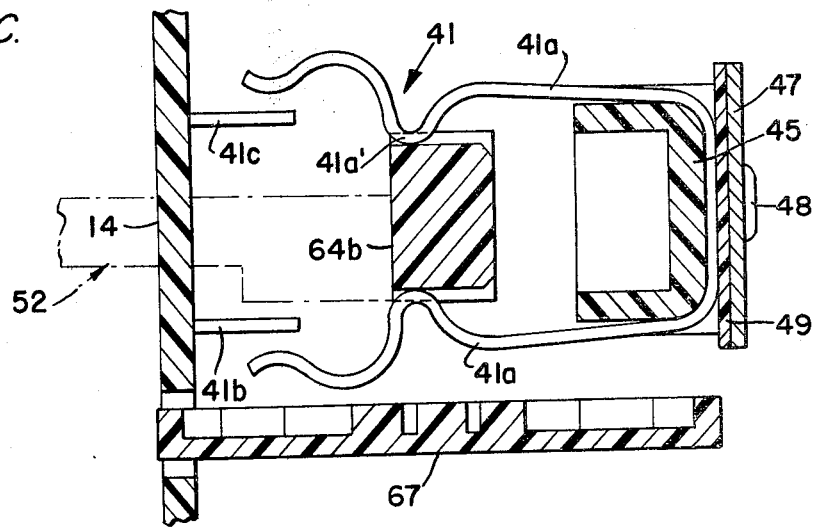

The latching mechanism for latching the actuator 52 may be appreciated from the Figures in the series of FIGS. 5A, B and C and FIGS. 7A, B, C and D.

The operative portion of actuator 52 includes a stud 66 extending from the surface opposite the cam element 61. The stud preferably is integral with the operative portion which may be molded or otherwise fabricated of plastic, such as that of members 44, and so forth. Similar studs may be seen in the Figures to extend from the operative portions of actuators 51 and 53.

A lock wheel 67 is received on the stud 66 and held captive in free rotation by a washer 68. As may be seen in FIG. 5A, the stud includes a pair of concentric surfaces, the first of which provides a bearing support for the lock wheel, while the second includes a groove for receipt of the washer. The lock wheel preferably is molded or otherwise fabricated of a plastic material, such as CELCON M90-04.

A locking pin 69 couples the actuator 52 and lock wheel 67. Specifically, the locking pin is received within a bore in the rear portion of the actuator to extend upwardly (see FIG. 5A) into the region of a track 70 formed in one surface of the lock wheel. To provide longevity of operation, the lock pin is formed of CRS rod and may be nickel-plated.

The track 70 (see FIGS. 7A–D) includes a plurality of grooves 70*a* arranged substantially radially about the axis of rotation of the lock wheel and an annular track 70*b* into which the grooves merge. The inner surface of the track is of fluted outline to include a plurality of pockets 70*c* closer to the axis of rotation than the track. The outer surface is likewise fluted and similarly includes a plurality of pockets 70*d* more distant from the axis of rotation than the track. The outer pockets are substantially equiangularly spaced. The inner pockets, also, are equiangularly spaced, yet at an angle of about twice that of the outer pockets. Thus, there are twice as many outer pockets as there are inner pockets thereby, with the grooves 70*a*, permitting the latching operation, to be discussed.

The latching of actuator 52 is carried out through movement of the actuator inwardly from the "center" position so that lock pin 69 moves from within groove 70*a* to a position in contact with the outer surface of track 70*b*. Further movement causes the lock wheel to rotate counterclockwise, as seen in FIG. 7A. The lock pin and lock wheel move relatively as the lock pin follows the outer surface toward pocket 70*d* (see the arrow in FIG. 7B). This position of the lock pin represents the furthestmost position of inward travel of actuator 52 and may be likened to the position of the operative portion of the actuator in contact with member 45.

During this movement, the follower surfaces 55*c* of detent spring 55 reside at varying positions along the base 62*a* of cam element 62. The resilient biasing force acting to return the legs together, imparts movement to the actuator in return automatically to the "center" position. In this movement, the lock pin 69 leaves the pocket 70*d* and moves toward the inner surface of track 70*b* (see FIG. 7C). Action, similar to that in movement of the lock pin from the FIG. 7A to FIG. 7B follows until the lock pin locates in pocket 70*c*. This is the latched position of actuator 52.

Figure 5C:
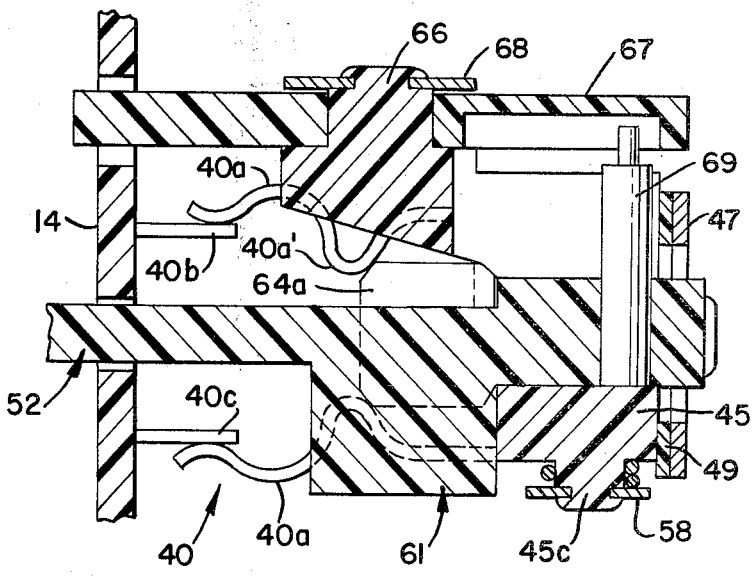
FIGS. 5B and 5C are views similar to FIG. 5A, yet illustrating the actuator of a switch apparatus in different positions.
Figure 5B:
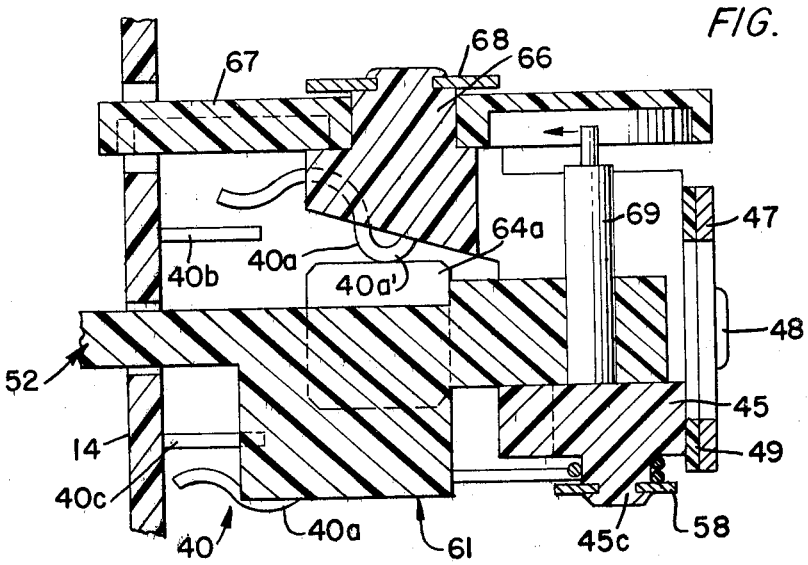

To release the latch, actuator 52 is pushed in, once again, whereupon the lock pin 69 locates to an outer pocket 70*b* and then to the next following groove 70*a*. The action duplicates that action described with regard to FIGS. 7A, 7B and 7C. The positioning of the lock pin 69, relative to groove 70*a*, may be seen in FIGS. 5A, 5B and 5C.

The operation of the switch apparatus described above may be further exemplified by the following discussion. The actuators 51 and 53, controlling the functions DATE and TIME, respectively, normally are located in the "center" position at which the switches 38, 39, 42 and 43 are open. To this end, the followers 38*a*′ of movable contact arm 38 are disposed on the upper and lower surfaces or cams of wing 63*a*. This disposition of the followers maintains the contact portions of the movable contact arm in a position removed from the stationary contacts 38*b,c*. The followers of the other movable contact arms similarly are disposed on the cams of the respective wings. These switches, likewise, are open. Since the actuators 51 and 53 provide the same operations, the discussion pertaining to this group of switches will continue primarily with a discussion of switch 38.

If the actuator 51 is moved to the "in" position, upon depressing button 23, switch 38 will close. For this operation, the followers 38*a*′ are located along the cams to almost immediately fall from the wing 63*a* as the cams move rearwardly. The wing 63*b* is coextensive with wing 63*a* in that direction of movement and the same action results. Thus, the contact portions of the movable contact arm 38*a* wipe the stationary contacts 38*b,c* to complete the circuit.

If the actuator 51 is moved to the "out" position by pulling on button 23, the switch 38 will remain open. In this connection, the length of cams of wing 63 is such that the distance through which the actuator is permitted to move is less than that necessary for the followers to fall off the cams. However, the wing 63*b* is not coextensive with wing 63*a* in outward movement of the actuator 51 and, therefore, the followers 39*a*′ of movable contact arm 39*a* almost immediately fall from the wing 63*b* as the cams move outwardly. The contact portions of movable contact arm 39*a*, therefore, will wipe the stationary contacts 39*b,c* to complete that circuit.

The actuator 52, controlling the function E/T, also is normally located in the "center" position at which switches 40 and 41 are open. To this end, the followers 40*a*′ and 41*a*′ of movable contact arms 40*a* and 41*a* are disposed on the upper and lower surfaces or cams of wings 64*a,b*. This disposition of the followers maintain the contact portions of the movable contact arms 40*a* and 41*a* in a position removed from the stationary contacts 40*b,c* and 41*b,c*. Since the wings 64*a,b* are coextensive one with the other throughout a relatively short length of movement from the "center" position, the switch 40 will close upon movement of actuator 52 in one direction of movement and the switch 41 will close upon movement of the actuator in the opposite direction. Particularly, the followers 40*a*′ will fall from the wing 64*a* as the cams move a small distance inwardly so that the contact portions of movable contact arm 40*a* wipe the stationary contacts 40*b,c*. And, the followers 41*a*′ will fall from the wing 64*b* as the cams move a small distance outwardly so that the contact portions of movable contact arm 41*a* wipe the stationary contacts 41*b,c*.

The particular circuit operation through each manipulation of a button 28, 29 and 30 and the respective actuator to be controlled has previously been described, as has the operation for latching each actuator in one of the positions from a "center" position. The physical orientation of the switches, i.e., either open or closed, is also set out in the Table, above. Further, it is contemplated that an actuator, such as actuator 51, provide a somewhat different switch operation. To this end, the stationary contacts 38*b,c* of the switch 38, heretofore described as being connected in a single circuit, may be connected in individual circuits completed through the movable contact arm 38*a* and a connector (not shown). The connector may be connected to the movable arm within the region of member 44, for example. This switch operation contemplates that the structure of the wing 63*a* be such to provide upper and lower surfaces for interaction, respectively, with reversely curved surfaces 38*a*′ but that the surfaces are not coextensive throughout their lengths. As an example, the upper surface and lower surface of wing 63*a* may terminate toward the circuit board 14 at the same or different location and they may be continuous but, as set out, not coextensive throughout their full length toward member 44 or may even comprise a series of discontinuities. Thus, a circuit between the connector and stationary contacts 38*b,c* may be completed at the same or different times, and either circuit path may be opened or closed in any desired sequence of operation.

Having described the invention with particular reference to the preferred form thereof, it will be obvious to those skilled in the art to which the invention pertains after understanding the invention, that various changes and modifications may be made therein without departing from the spirit and scope of the invention as defined by the claims appended hereto.

We claim:

1. In combination with a digital display device including an electronics package capable of display of any one of a plurality of changing functions and a source of power for energizing said electronics package, of switch means for activating a predetermined one of said changing functions, said switch means including at least a stationary and movable contact, means for supporting said contacts, an actuator, means for supporting said actuator for movement selectively from a normal position of rest between two extremes longitudinally in either of two opposite directions for controlling movement of each said movable contact to contact closing and opening conditions, means for biasing said actuator toward said position of rest following movement in one of said directions, and latch means for latching said actuator to prevent said actuator from returning to said position of rest following movement in the other opposite direction.

2. The combination of claim 1 further including a cam element, said cam element having a pair of walls extending in the direction of movement of said actuator, yet divergent outward from a central grooved area, a detent spring also extending in the direction of movement of said actuator having a follower portion, and means for supporting said detent spring so that said follower portion is adapted to ride on said walls, said cam element being supported on said actuator and the biasing effect of said detent spring acting to return said actuator toward the position of rest increasing as the distance in movement of said actuator from said rest position increases.

3. The combination of claim 2 wherein said support means includes a stationary member, said member including an opening providing a guideway for said actuator in movement, a stud extending from said member, and said detent spring being mounted on said stud.

4. The combination of claim 1 wherein said support means includes a stationary member, said movable contact mounted by said member to extend toward said stationary contact, said contacts normally being closed, and a wing including a surface for engagement with said movable contact to relocate said movable contact to an open position, said wing being carried by said actuator.

5. The combination of claim 1 wherein said support means includes a stationary member, said movable contact mounted by said member to extend toward said stationary contact, said contacts normally being closed, and a wing including a surface for engagement with said movable contact to relocate said movable contact to an open position, said wing being carried by said actuator.

6. The combination of claim 1 including a plurality of switch means each controlling a different function.

7. The combination of claim 1 including a pair of stationary contacts and a pair of movable contacts, said actuator in said movement controlling movement of each said movable contact either to a contact closing or opening condition and wherein the controlled movement of said movement contacts need not be the same.

8. Switch apparatus for activating a predetermined one of a plurality of changing functions of a digital display energized by a powered electronics package, said switch apparatus including switch means comprising at least a stationary and movable contact, means for supporting said contacts, an actuator, means for supporting said actuator for movement selectively from a normal position of rest longitudinally in either direction for controlling movement of each of said movable contact to contact closing and opening conditions, means for biasing said actuator toward said position of rest following movement in one of said directions, and latch means for latching said actuator to prevent said actuator from returning to said position of rest following movement in the other direction.

9. The switch apparatus of claim 8 wherein said support means includes a stationary member, said movable contact mounted by said member to extend toward said stationary contact, said contacts normally being closed, and a wing including a surface for engagement with said movable contact to relocate said movable contact to an open position, said wing being carried by said actuator.

10. The switch apparatus of claim 8 wherein said support means includes a stationary member, said movable contact mounted by said member to extend toward said stationary contact, said contacts normally being closed, and a wing including a surface for engagement with said movable contact to relocate said movable contact to an open position, said wing being carried by said actuator.

11. The switch apparatus of claim 8 including a pair of stationary contacts and a pair of movable contacts, said actuator in said movement controlling movement of each said movable contact either to a contact closing or opening condition and wherein the controlled movement of said movement contacts need not be the same.

12. In combination with a digital display device including an electronics package capable of display of any one of a plurality of changing functions and a source of power for energizing said electronics package, of switch means for activating a predetermined one of said changing functions, said switch means including at least a stationary and movable contact, an actuator, a cam element, said cam element having a pair of walls extending in the direction of movement of said actuator, yet divergent outward from a central grooved area, means for supporting both said contacts and said actuator whereby said actuator is capable of movement from a normal position of rest longitudinally in either direction for controlling movement of each said movable contact to contact closing and opening conditions, said support means for said actuator including a stationary member, a post extending from said stationary member, means for biasing said actuator toward said position of rest in return movement following movement in at least one of said directions, said biasing means including a detent spring also extending in the direction of movement of said actuator having a follower, means for supporting said detent spring so that said follower portion is adapted to ride on said walls, said cam element being supported on said actuator and the biasing effect of said detent spring acting to return said actuator toward the position of rest increasing as the distance in movement of said actuator from said rest position increases, latch means including a lock wheel mounted for rotation on said post, said lock wheel having a surface formed with a plurality of latching pockets, unlatching radial grooves, and a track connecting said pockets and grooves, and a lock pin carried by said actuator to extend into said track whereby upon movement of said actuator in one direction from said position of rest said lock pin remains in a groove and upon movement of said actuator in the opposite direction said lock pin follows said track, rotates said lock wheel and relocates to an angularly spaced latching pocket.

13. The combination of claim 12 wherein said unlatching grooves are equiangularly spaced and said latching pockets, also, equiangularly spaced are located between said grooves, said unlatching grooves and latching pockets forming an inner fluted track path, and said track including an outer fluted path, the inner and outer paths toward said pockets including surfaces which diverge outwardly in an alternating manner therearound.

14. In combination with a digital display device including an electronics package capable of display of any one of a plurality of changing functions and a source of power for energizing said electronics package, of switch means for activating a predetermined one of said changing functions, said switch means including at least a stationary and movable contact, an actuator, means for supporting both said contacts and said actuator whereby said actuator is capable of movement from a normal position of rest longitudinally in either direction for controlling movement of each said movable contact to contact closing and opening conditions, said support means for said actuator including a stationary member, a post extending from said stationary member, means for biasing said actuator toward said position of rest in return from at least one of said directions, and latch means for latching said actuator in one position away from said position of rest, said latch means including a lock wheel mounted for rotation on said post, said lock wheel including a plurality of latching pockets, unlatching radial grooves and a track connecting said pockets and grooves, a lock pin carried by said actuator extending into said track, and means in said track for providing a path of relative movement of said lock pin and lock wheel as said actuator is moved in a latching direction from said position of rest.

15. The combination of claim 14 wherein said means in said track includes an inner fluted path formed by said grooves, latching pockets and a plurality of connecting wall lengths which are divergent outward, and an outer fluted path including similar wall lengths connecting a plurality of indexing pockets.

16. The combination of claim 15 wherein said latching pockets are equiangularly spaced about the axis of rotation of said lock wheel and said grooves are equidistantly spaced between said latching pockets, and said outwardly divergent wall lengths of said inner and outer paths are disposed in an alternating manner whereby upon movement of said actuator in a latching direction said lock pin moves toward an outer wall length, into a pocket, toward an inner wall length under a return bias force and into a latching pocket causing said lock to index in one direction of rotation.

17. In combination with digital display device including an electronics package capable of display of any one of a plurality of changing functions and a source of power for energizing said electronics package, of switch means including at least a stationary and movable contact, an actuator, a cam element, said cam element having a pair of walls extending in the direction of movement of said actuator, said walls being divergent outward from a central grooved area, means for supporting both said contacts and said actuator whereby said actuator is capable of movement from a normal position of rest longitudinally in either direction for controlling movement of each said movable contact to contact closing and opening conditions, means for biasing said actuator toward said position of rest in return from at least one of said directions including a detent spring also extending in the direction of movement of said actuator having a follower portion, means for supporting said detent spring so that said follower portion is adapted to ride on said walls, said cam element being supported on said actuator and the biasing effect of said detent spring acting to return said actuator in a direction opposite to the direction of movement toward the position of rest increasing as both the distance in movement of said actuator from said rest position and the distance in movement of said follower portion from the longitudinal axis increases, and latch means for latching said actuator in one position away from said position of rest.

18. The combination of claim 17 wherein said actuator is latched following movement from said rest position in the other direction.

19. Switch apparatus for activating a predetermined one of a plurality of changing functions of a digital display energized by a powered electronics package, said switch apparatus including switch means comprising at least a stationary and movable contact, an actuator, a cam element, said cam element having a pair of walls extending in the direction of movement of said actuator, yet divergent outward from a central grooved area, means for supporting both said contacts and said actuator whereby said actuator is capable of movement from a normal position of rest longitudinally in either direction for controlling movement of each said movable contact to contact closing and opening conditions, said support means for said actuator including a stationar member, a post extending from said stationary member, means for biasing said actuator toward said position of rest in return movement following movement in at least one of said directions, said biasing means including a detent spring also extending in the direction of movement of said actuator having a follower portion, means for supporting said detent spring so that said follower portion is adapted to ride on said walls, said cam element being supported on said actuator and the biasing effect of said detent spring acting to return said actuator toward the position of rest increasing as the distance in movement of said actuator means from said rest position increases, latch means including a lock wheel mounted for rotation on said post and including a plurality of latching pockets, unlatching radial grooves, and a track connecting said pockets and grooves, and a lock pin carried by said actuator to extend into said track whereby upon movement of said actuator in one direction from said position of rest said lock pin remains in a groove and upon movement of said actuator in the opposite direction said lock pin follows said track, rotates said lock wheel and relocates to an angularly spaced latching pocket.

20. The switch apparatus of claim 19 further including a cam element, said cam element having a pair of walls extending in the direction of movement of said actuator, yet divergent outward from a central grooved area, a detent spring also extending in the direction of movement of said actuator hving a follower portion, and means for supporting said detent spring so that said follower portion is adapted to ride on said walls, said cam element being supported on said actuator and the biasing effect of said detent spring acting to return said actuator toward the position of rest increasing as the distance in movement of said actuator from said rest position increases.

21. The switch apparatus of claim 20 wherein said support means includes a stationary member, said member including an opening providing a guideway for said actuator in movement, a stud extending from said member, and said detent spring being mounted on said stud.

22. The switch apparatus of claim 19 wherein said unlatching grooves are equiangularly spaced and said latching pockets, also, equiangularly spaced are located between said grooves, said unlatching grooves and latching pockets foming an inner fluted track path, and said track including an outer fluid path, the inner and outer paths toward said pockets including surfaces which diverge outwardly in an alternating manner therearound.

23. Switch apparatus for activating a predetermined one of a plurality of changing functions of a digital display energized by a powered electronics package, said switch apparatus including switch means comprising at least a stationary and movable contact, an actuator, means for supporting both said contacts and said actuator whereby said actuator is capable of movement from a normal position of rest longitudinally in either direction for controlling movement of each said movable contact to contact closing and opening conditions, said support means for said actuator including a stationary member, a post extending from said stationary member, means for biasing said actuator toward said position of rest in return from at least one of said directions, and latch means for latching said actuator in one position away from said position of rest, said latch means including a lock wheel mounted for rotation on said post, said lock wheel including a plurality of latching pockets, unlatching radial grooves and a track connecting said pockets and grooves, a lock pin carried by said actuator extending into said track, and means in said track for providing a path of relative movement of said lock pin and lock wheel as said actuator is moved in a latching direction from said position of rest.

24. The switch apparatus of claim 23 wherein said means in said track includes an inner fluted path formed by said grooves, latching pockets and a plurality of connecting wall lengths which are divergent outward, and an outer fluted path including similar wall lengths connecting a plurality of indexing pockets.

25. The switch apparatus of claim 24 wherein said latching pockets are equiangularly spaced about the axis of rotation of said lock wheel and said grooves are equidistantly spaced between said latching pockets, and said outwardly divergent wall lengths of said inner and outer paths are disposed in an alternating manner whereby upon movement of said actuator in a latching direction said lock pin moves toward an outer wall length, into a pocket, toward an inner wall length under a return bias force and into a latching pocket causing said lock to index in one direction of rotation.

26. Switch apparatus for activating a predetermined one of a plurality of changing functions of a digital display energized by a powered electronics package, said switch apparatus including switch means comprising at least a stationary and movable contact, an actuator, a cam element, said cam element having a pair of walls extending in the direction of movement of said actuator, said walls being divergent outward from a central grooved area, means for supporting both said contacts and said actuator whereby said actuator is capable of movement from a normal position of rest longitudinally in either direction for controlling movement of each said movable contact to contact closing and opening conditions, means for biasing said actuator toward said position of rest in return from at least one of said directions including a detent spring also extending in the direction of movement of said actuator having a follower portion, and means for supporting said detent spring so that said follower portion is adapted to ride on said walls, said cam element being supported on said actuator and the biasing effect of said detent spring acting to return said actuator in a direction opposite to the direction of movement toward the position of rest increases as both the distance in movement of said actuator from said rest position and the distance in movement of said follower portion from the longitudnal axis increases, and latch means for latching said actuator in one position away from said position of rest.

27. The switch apparatus of claim 26 wherein said actuator is latched following movement from said rest position in the other direction.

* * * * *